US008419080B2

(12) United States Patent
Levine

(10) Patent No.: US 8,419,080 B2
(45) Date of Patent: Apr. 16, 2013

(54) DRAWER SAFETY LATCH

(76) Inventor: Bruce Levine, Gilbert, AZ (US)

( * ) Notice: Subject to any disclaimer, the term of this patent is extended or adjusted under 35 U.S.C. 154(b) by 1422 days.

(21) Appl. No.: 11/673,504

(22) Filed: Feb. 9, 2007

(65) Prior Publication Data

US 2008/0191496 A1 Aug. 14, 2008

(51) Int. Cl.
*E05C 19/06* (2006.01)
*E05C 19/00* (2006.01)

(52) U.S. Cl.
USPC ..... 292/84; 292/87; 292/303; 292/DIG. 15; 292/DIG. 63; 292/DIG. 65; 312/333

(58) Field of Classification Search ..... 292/84, 292/87, 92, 303, DIG. 15, DIG. 38, DIG. 63, 292/DIG. 65; 312/333
See application file for complete search history.

(56) References Cited

U.S. PATENT DOCUMENTS 461,375 A * 10/1891 Spaunhorst ..... 312/330.1
3,381,992 A * 5/1968 Friesen ..... 292/87
3,397,001 A * 8/1968 Friedman ..... 292/87
3,850,463 A 11/1974 Hawkins
4,416,477 A * 11/1983 Bialobrzeski et al. ..... 292/19
4,505,526 A 3/1985 Leck
4,542,924 A * 9/1985 Brown et al. ..... 292/87
4,638,649 A * 1/1987 Chao ..... 70/71
4,688,023 A * 8/1987 McGill et al. ..... 340/545.6
4,715,628 A * 12/1987 Brink et al. ..... 292/19
5,730,514 A * 3/1998 Hashemi ..... 312/333
5,769,517 A 6/1998 Carde
5,795,044 A 8/1998 Trewhella, Jr. et al.
6,729,703 B2 * 5/2004 Le ..... 312/333
6,955,380 B1 10/2005 Barr
7,261,329 B1 * 8/2007 Julian et al. ..... 292/84

* cited by examiner

*Primary Examiner* — Carlos Lugo
(74) *Attorney, Agent, or Firm* — Keith L. Jenkins, Registered Patent Attorney, LLC; Keith L. Jenkins

(57) ABSTRACT

A drawer safety latch that is securable, preferably releasably so, to a top surface of a drawer side structure, such as a sidewall, in one of two different orientations. The safety latch is quickly installed without modifying the drawer, is easily aligned, and can be oriented so that children shorter than the drawer cannot see the release mechanism. The drawer safety latch is preferably of one-piece, injection-molded construction, but other materials and manufacturing methods may be used. The drawer safety latch is preferably secured with releasable adhesive fabric, and so is portable for travel. In some embodiments, the drawer safety latch may have aesthetic and/or traction enhancements. The drawer safety latch has right-handed and left-handed versions that may be used alone or together, in the same or different orientations.

26 Claims, 9 Drawing Sheets

DRAWER SAFETY LATCH

FIELD OF THE INVENTION

The present invention relates to safety latches for drawers and similar extractable containers. The present invention further relates to a drawer safety latch that can be quickly and easily installed in one of two orientations on a top surface of a drawer side structure, such as a drawer sidewall, without modifying or penetrating the cabinet or drawer.

BACKGROUND OF THE INVENTION

Drawer safety latches have been developed for consumer purchase and installation which, when installed, require an extra step of manipulation from the user in order to open a given drawer. The purpose of this extra step is to make opening the drawer more difficult for children, thereby protecting the children from dangerous contents, such as knives, which may be kept in the drawer.

A number of two-piece drawer latches are on the market, such as that disclosed in U.S. Pat. No. 4,505,526. That two-piece drawer latch has a hooked extension attached to the drawer that the consumer must attach to the drawer and a catch for the hook, which the consumer must align to the hooked extension and install on the cabinet. These steps are fraught with opportunities for frustration, as a small misalignment will render the device useless. Also, the positioning of the device interferes with manual access to the contents of the drawer.

U.S. Pat. No. 5,794,044 teaches a one-piece safety latch that is secured to an exterior surface of the drawer by threaded fasteners (screws or bolts). The safety latch extends outward to abut a cabinet frame member with a stepped abutment when the drawer is moved toward an open position. An extension from the abutment is used to manually release the abutment and open the drawer. One disadvantage of this approach is that holes have to be made in the drawer. For antique or expensive desks and cabinets, this approach may be unacceptable. Furthermore, by placing the entire latch on an exterior of the drawer, the release is made easily accessible to children. Yet another disadvantage is the time required for installation, as alignment may be difficult.

U.S. Pat. No. 6,955,380 describes a latch that adheres to the interior wall of the drawer and extends out into the drawer to support a latch that engages the upper cabinet frame member defining the opening for the drawer. This latch engages the cabinet frame when opening or closing the drawer. The gap in the latch, which is fixed in size, may not fit all cabinet frame members. In some applications, the latch may not be installable high enough to engage the cabinet frame member. Because it extends over the cabinet interior when not in use, it interferes with manual access to the contents of the drawer. The release for this latch rises above the drawer top, where children can easily see it.

OBJECTS AND FEATURES OF THE INVENTION

A primary object and feature of the present invention is to provide a more effective, yet easy to install, drawer safety latch. It is a further object and feature of the present invention to provide such a drawer safety latch that can be installed in either of two orientations to engage either an environmental obstacle at the side of the drawer or an environmental obstacle above the drawer. It is a further object and feature of the present invention to provide such a drawer safety latch that can be easily installed in seconds and easily removed in seconds. It is a further object of the invention to provide a drawer safety latch that can be installed in a position that keeps the release below the top of the drawer and out of sight of small children. It is yet another object of this invention to provide a drawer safety latch for both left-hand sides and right-hand sides of drawers, alone or simultaneously. It is yet another object and feature of the present invention to provide a drawer safety latch that is releasably securable to at least one portion of a top surface of a drawer sidewall. It is yet another object and feature of the present invention to provide such a safety drawer latch made of a material that can be trimmed with scissors for custom installation. It is yet another object and feature of the present invention to provide such a drawer safety latch with an L-shaped mounting bracket that is stable, removable, and capable of being installed in one of two different orientations. It is yet another object and feature of the present invention to provide such a drawer safety latch that does not permanently modify or penetrate the cabinet or drawer upon which it is used, and so is portable for travel. It is yet another object and feature of the present invention to provide such a drawer safety latch that may be installed on a wide variety of drawer and cabinet materials and configurations. A further primary object and feature of the present invention is to provide such a drawer safety latch that is efficient, inexpensive, and handy. Other objects and features of this invention will become apparent with reference to the following descriptions.

SUMMARY OF THE INVENTION

In accordance with a preferred embodiment hereof, this invention provides a more effective, yet easy to install, drawer safety latch. The drawer safety latch can be installed in either of two orientations to engage either an environmental obstacle at the side of the drawer or an environmental obstacle above the drawer. The drawer safety latch can be easily installed in seconds and easily removed in seconds. The drawer safety latch can be installed in a position that keeps the release below the top of the drawer and out of sight of small children. The drawer safety latch is available for both left-hand sides and right-hand sides of drawers, alone or simultaneously. The drawer safety latch is releasably securable to at least one portion of a top surface of a drawer sidewall. The safety drawer latch is preferably made of a material that can be trimmed with scissors for custom installation. The drawer safety latch preferably has an L-shaped mounting bracket that is stable, removable, and capable of being installed in one of two different orientations. The drawer safety latch does not permanently modify or penetrate the cabinet or drawer upon which it is used, and so is portable for travel. The drawer safety latch may be installed on a wide variety of drawer and cabinet materials and configurations. The drawer safety latch is efficient, inexpensive, and handy.

BRIEF DESCRIPTION OF THE DRAWINGS

The above and other objects and advantages of the present invention will become more apparent from the following description taken in conjunction with the following drawings in which.

DETAILED DESCRIPTION OF THE BEST MODES AND PREFERRED EMBODIMENTS OF THE INVENTION

Figure 1A:
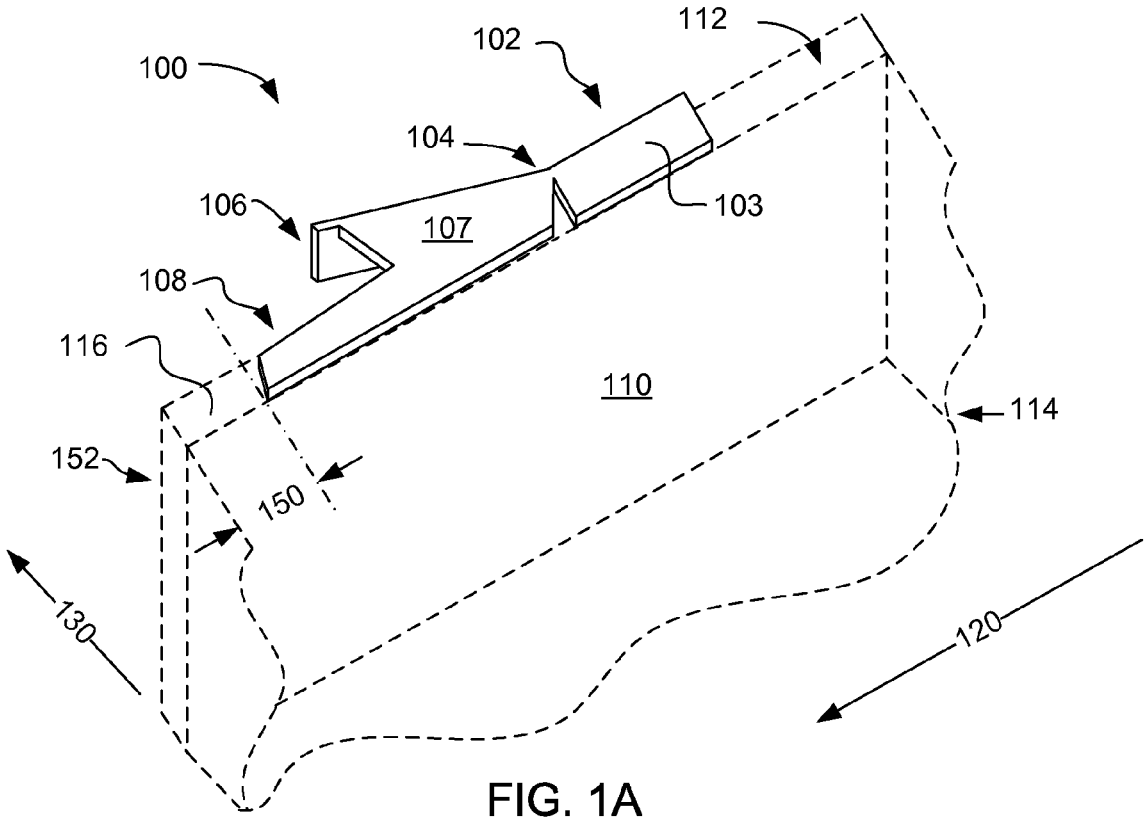
FIG. 1A is a perspective view illustrating an exemplary drawer safety latch installed on a drawer side structure in a first orientation, according to a preferred embodiment of the present invention.

FIG. 1A is a perspective cut away view illustrating an exemplary drawer safety latch 100 installed on a drawer side structure 116 in a first orientation, according to a preferred embodiment of the present invention. The interior 114 of the drawer is defined, in part, by drawer side structure 116. In the first position, as shown, the mounting portion 102, or mounting bracket, has a first mounting portion 103 and a bracing extension 105 (see FIG. 1B), which extends at an angle from first mounting portion 103 to abut the exterior surface of the drawer side structure 116. While the conventional drawer side structure 116 is a simple sidewall, as shown, those of skill in the art will appreciate the various drawer side structures that may be encountered, including those with more than one top surface or ledges on the exterior surface of the drawer side structure 116.

Mounting portion 102 is preferably secured to the top surface 112 of drawer side structure 116. Preferably, drawer safety latch 100 is made of a resilient material, enabling first mounting portion 103 and bracing extension 105 to be constrained to conform to a top surface 112 that is rounded, when secured thereto. Securing may be by adhesive between the top surface 112 of the drawer side structure 116 and the first mounting portion 103, or by other means, as will be discussed further below. Flexible portion, or flexible coupling, 104 couples the mounting portion 102 to the obstructing portion 106. The obstructing portion 106 extends forward 120 and is biased outward 130 from the drawer side structure 116 in order to engage an environmental obstacle (not shown). The environmental obstacle may be, for example, a frame member for the cabinet opening through which the drawer moves to the open position. In some installations, the consumer may supply the environmental obstacle. The obstructing portion 106 includes a panel 107 that is oriented in a plane at an angle (preferably, perpendicular) to the bracing extension 105. While the panel 107 is shown as continuous, it may be, in alternate embodiments, perforated, latticed, or otherwise discontinuous.

Release portion 108, or releasing member, extends forward 120 from obstructing portion 106 and is manually operable to release obstructing portion 106 from engagement with an environmental obstacle. Release portion 108 should extend for a length that is greater than the forward 120 dimension of the anticipated environmental obstruction. This ensures that the release will extend past the obstruction. In an alternate embodiment, release 108 may be manufactured to be longer than generally needed, and may then be trimmed by the consumer, using scissors, to be about one to two inches longer than the forward dimension of the environmental obstacle. The drawer safety latch 100 is positioned on the top surface 112 of drawer side structure 116 behind the front 152 of the drawer side structure 116 by a distance 150 that is slightly greater than one user's finger width to ensure manual access to the release 108.

Figure 1B:
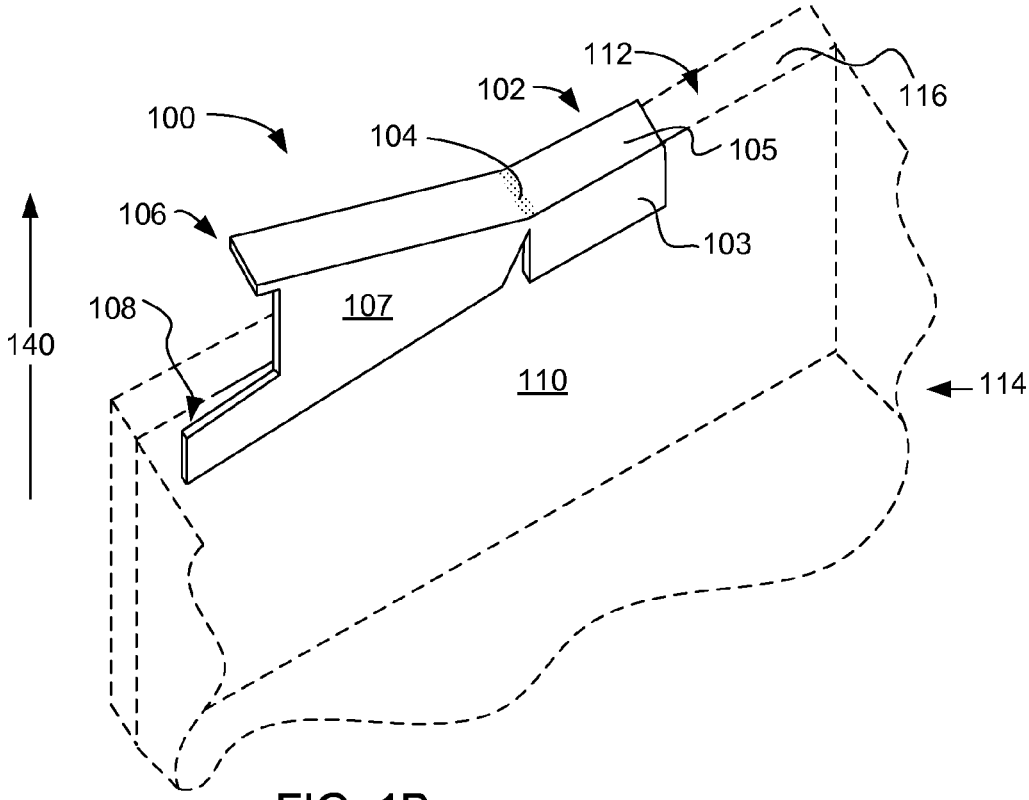
FIG. 1B is a perspective view illustrating the exemplary drawer safety latch of FIG. 1A installed on the drawer side structure of FIG. 1A in a second orientation, according to a preferred embodiment of the present invention.

FIG. 1B is a perspective view illustrating the exemplary drawer safety latch 100 of FIG. 1A installed on the drawer side structure 116 of FIG. 1A in a second orientation, according to a preferred embodiment of the present invention. By simply rotating the drawer safety latch 100 ninety degrees about its long axis, a second orientation for installation on drawer side structure 116 can be achieved, as shown. The ability to install the drawer safety latch 100 in one of two orientations at the same position on the drawer is one of the novel features of this invention. In this second orientation, first mounting portion 103 now performs the function of bracing extension 105, and bracing extension 105 serves the function of first mounting portion 103. In this orientation, obstructing portion 106 is biased upwardly 140 to engage an environmental obstacle above the drawer side structure 116. The release portion 108 is preferably lower than the top surface 112 of drawer side structure 116, deterring children who are shorter than the drawer top from seeing how to release the drawer safety latch 100. The particular illustrated shapes of obstructing portion 106 and panel 107 are not meant to be limiting, as will be discussed further below.

Figure 2:
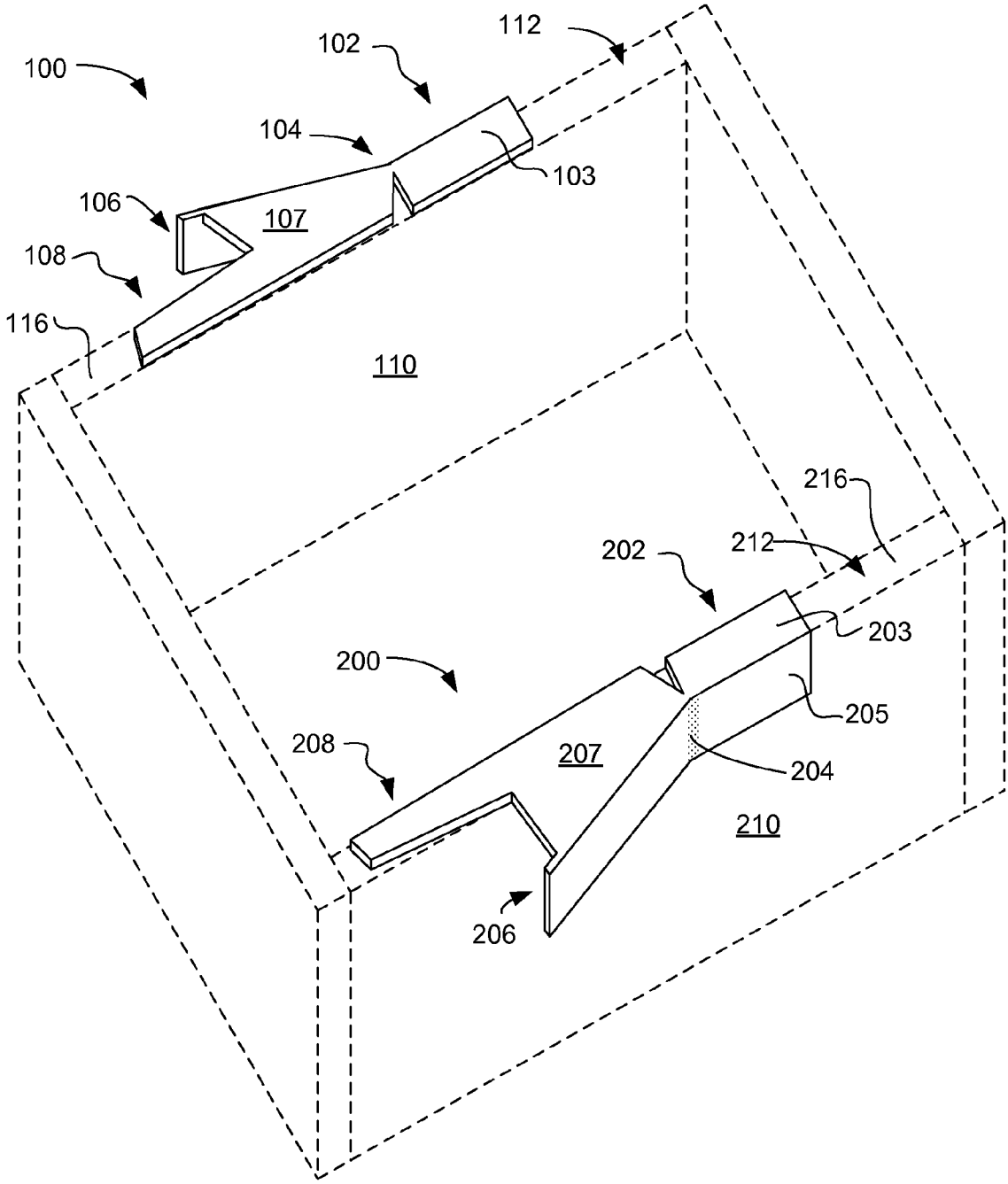
FIG. 2 is a perspective view illustrating exemplary drawer safety latches for both a right-hand side of a drawer and a left-hand side of a drawer, each drawer safety latch illustrated in a first orientation, according to a preferred embodiment of the present invention.

FIG. 2 is a perspective view illustrating exemplary drawer safety latches 100 and 200 for both a right-hand side structure 116 of a drawer and a left-hand side structure 216 of a drawer, each drawer safety latch 100 is illustrated in the first orientation, according to a preferred embodiment of the present invention. By using drawer safety latches 100 on each side structure 116 and 216 of the drawer, the errant child is further deterred from gaining entry to the drawer. The right-handed drawer safety latch 200 is a mirror image of right-handed drawer safety latch 100. First mounting portion 203 engages and is secured to top surface 212 of right-hand drawer side structure 216. Bracing extension 205 abuts the exterior surface 210 of right-hand drawer side structure 216. Flexible coupling 204 may be integral to the one-piece, injection-molded plastic drawer safety latch 200. Flexible coupling 204 may also be shaped and arranged to create the outward bias of the obstructing portion 206. The obstructing portion 206 includes a panel 207 that is oriented in a plane at an angle (preferably, perpendicular) to the bracing extension 205. Release portion 208 is shown inward of the exterior surface 210.

While drawer safety latches 100 and 200 are preferably injection molded, a right-angled section of plastic can be cut to form drawer safety latches 100 and 200. The cutting may be accomplished with scissors, a knife, or an industrial cutting machine.

Figure 3:
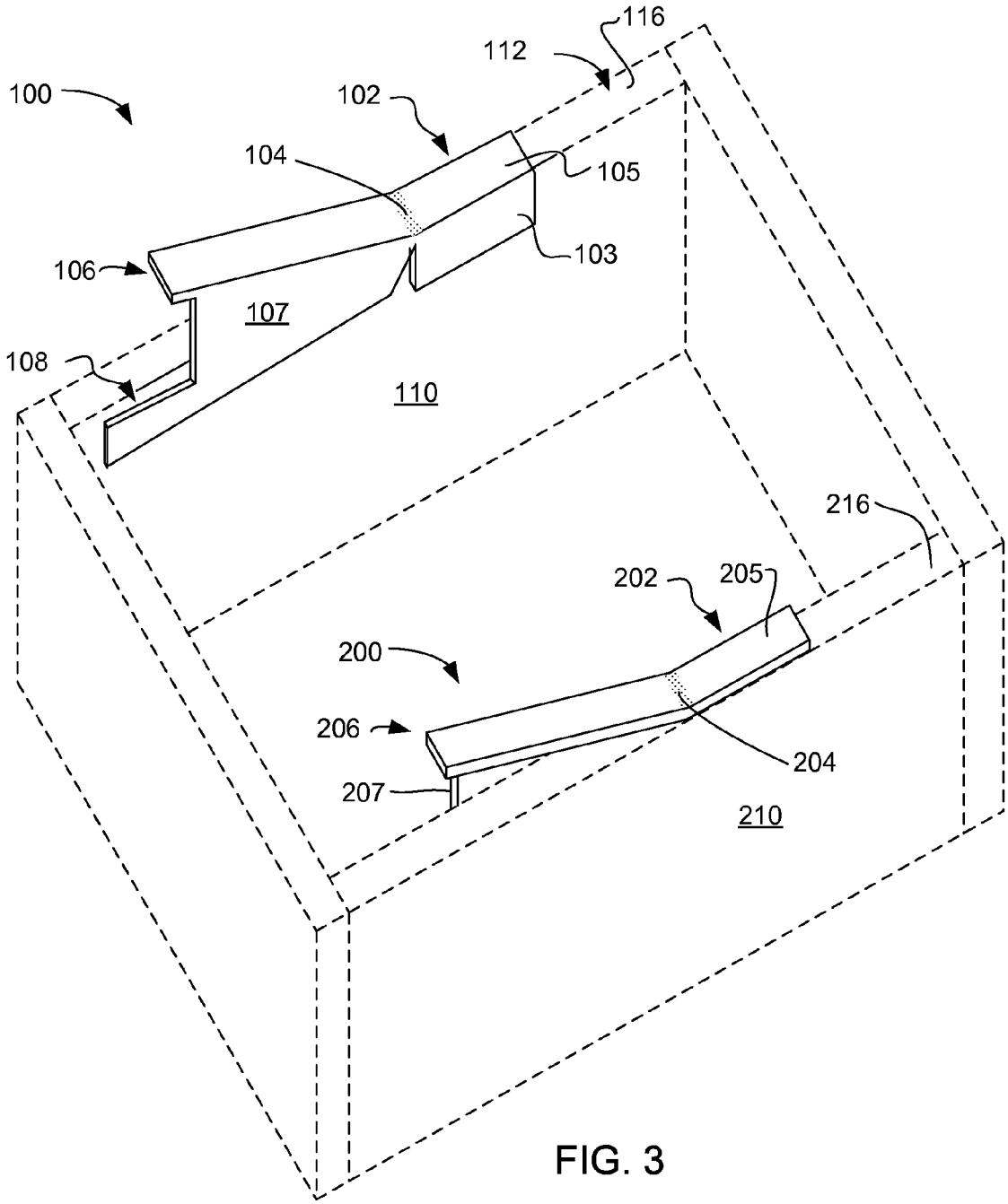
FIG. 3 is a perspective view illustrating exemplary drawer safety latches for both a right-hand side of a drawer and a left-hand side of a drawer, each drawer safety latch illustrated in a second orientation, according to a preferred embodiment of the present invention.

FIG. 3 is a perspective view illustrating exemplary drawer safety latches 100 and 200 for both a right-hand side structure 116 of a drawer and a left-hand side structure 216 of a drawer, each drawer safety latch 100 and 200 illustrated in a second orientation, according to a preferred embodiment of the present invention. Both release portions 108 and 208 are below the drawer tops 112 and 212, respectively, making it extremely difficult for a small child to defeat the drawer safety latches 100 and 200. While both drawer safety latches 100 and 200 are shown in the same second orientation, those of skill in the art, enlightened by this specification, will appreciate that each of drawer safety latches 100 and 200 may have a different orientation. Those of skill in the art, enlightened by this disclosure, will appreciate that drawer safety latches 100 and 200 may be of various sizes. In a particular embodiment, a drawer safety latch 100 may be marketed that is larger than is usually needed, with instruction on how to trim the drawer safety latch 100 down to an appropriate custom size using scissors.

Figure 4:
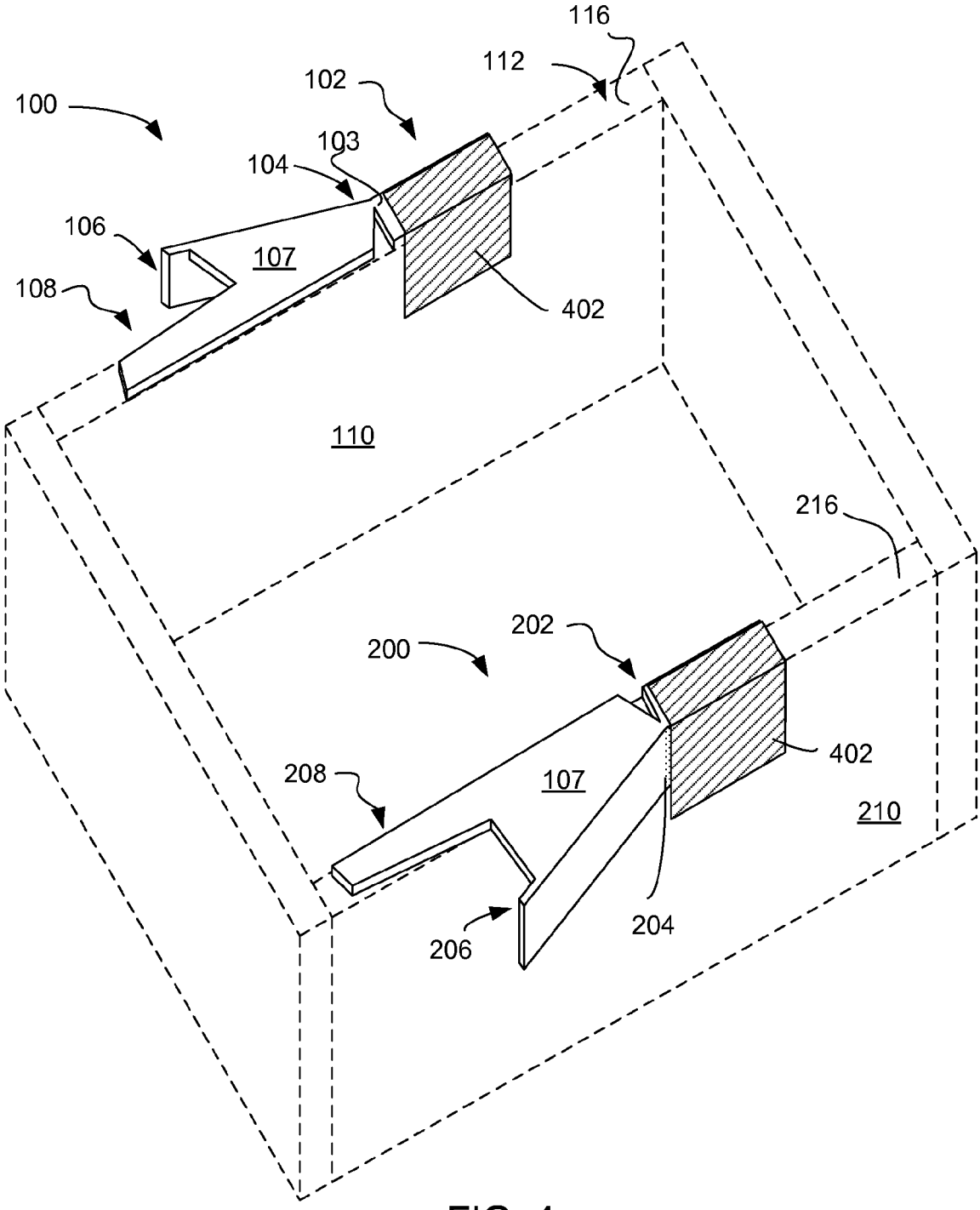
FIG. 4 is a perspective view illustrating exemplary drawer safety latches 100 and 200 secured to top surfaces using an adhesive fabric, according to a preferred embodiment of the present invention.

FIG. 4 is a perspective view illustrating exemplary drawer safety latches 100 and 200 secured to top surfaces 112 and 212 using an adhesive fabric 402, according to a preferred embodiment of the present invention. The adhesive fabric 402 is preferably a heavy polymer sheet with a strong releasable adhesive. For drawer safety latch 100, the adhesive fabric 402 is first placed on the top of the first mounting portion 103 and, while exerting downward pressure to secure first mounting portion 103 to top surface 112 of drawer side structure 116, the adhesive fabric 402 is secured downward onto the side surfaces of drawer side structure 116. In an alternate embodiment, the adhesive fabric 402 is marketed already attached or adhered to first mounting portion 103, with the remainder of the adhesive fabric 402 covered with an easily removable film to prevent the adhesive from engaging prematurely.

For drawer safety latch 200, the adhesive fabric 402 is first placed on the top of the bracing extension 105 and, while exerting downward pressure to secure bracing extension 105 to top surface 212 of drawer side structure 216, the adhesive fabric 402 is secured downward onto the side surfaces of drawer side structure 216. Drawer safety latches 100 and 200 are preferably packaged together with adhesive fabric 402 as a complete sales unit, as discussed further below. In an alternate embodiment, the adhesive fabric 402 is marketed already attached or adhered to bracing extension 105, with the remainder of the adhesive fabric 402 covered with an easily removable film to prevent the adhesive from engaging prematurely.

Drawer safety latches 100 and 200 may each be installed one-handed by a simple process. First, the adhesive fabric is adhered to the outside of and extending beyond both the first mounting portion 103 and the bracing extension 105. Next, the drawer safety latch 100 is placed in the installation position on the drawer side structure 116. Finally, with the thumb on one side of the drawer side structure 116 and the fingers on the other side of drawer side structure 116, the adhesive fabric is secured to the sides of the drawer side structure 116, as shown.

While the exemplary embodiment is illustrated relative to an ordinary drawer, the invention is also useful on file cabinet drawers, and on a variety of extractable containers, as long as the container has some clearance between the container and the structure from which it withdrawn. For example, drawer safety latch 100 may be installed on metal drawers of a filing cabinet, the wooden drawers of a desk, or the plastic drawers of closet furniture. The wide range of applications for drawer safety latch 500 is one of the novel advantages of this invention.

Those of skill in the art, enlightened by this disclosure, will appreciate that, in alternate embodiments, permanent attachment of a drawer safety latch 100 to drawer side structure 116 is possible using screws, permanent adhesives, or other conventional means of permanent attachment. Likewise, in an alternate embodiment intended to be permanent, the capacity to choose between first and second orientations may be sacrificed by providing a second bracing extension, parallel to bracing extension 105 on the opposing side of first mounting structure 103, may be employed.

Figure 5A:
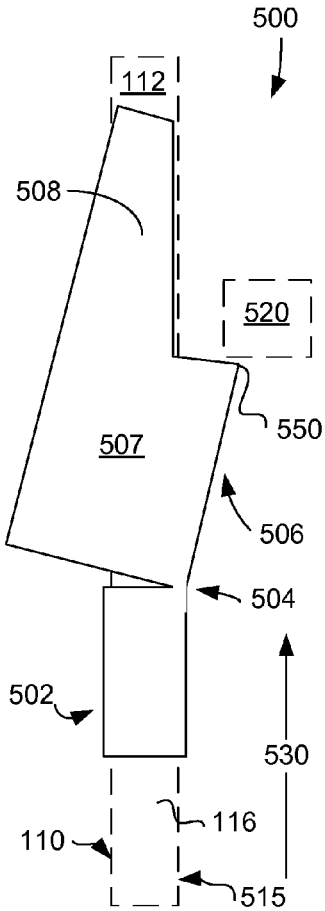
FIG. 5A is a top plan view illustrating an exemplary drawer safety latch engaging an environmental obstacle, according to a preferred embodiment of the present invention.

FIG. 5A is a top plan view illustrating an exemplary drawer safety latch 500 engaging an environmental obstacle 520, according to a preferred embodiment of the present invention. Mounting portion 502 is secured to the top surface 112 of drawer side structure 116. Flexible coupling 504 couples mounting portion 502 to obstructing portion 506. Release portion 508 extends forward 530 from the obstructing portion. Obstructing portion 506 is shown in its quiescent, outwardly biased state. In this state, obstructing portion 506 engages environmental obstacle 520 when the drawer side structure 116 moves forward 530. Engagement of the obstructing portion 506 with the environmental obstacle 520 prevents further forward 530 motion of the drawer. The shape of the obstructing portion 506 may vary considerably. Preferably, the point of engagement is near the point 550 of obstructing portion 506.

Drawer safety latch 500 may be trimmed with scissors, or similar means, to reduce the extent that panel 507 intrudes into the interior space of the drawer. Likewise, the point 550 and the release portion 508 may be shaped by the consumer by trimming as desired.

Figure 5C:
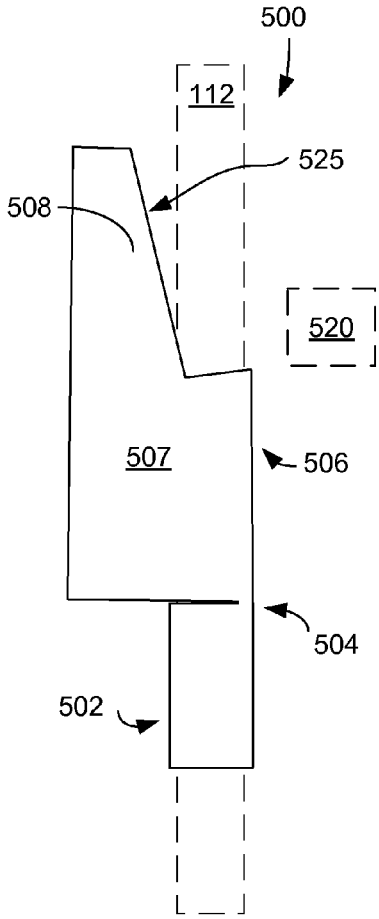
FIG. 5C is a top plan view illustrating an exemplary drawer safety latch released from engaging an environmental obstacle, according to a preferred embodiment of the present invention.
Figure 5E:
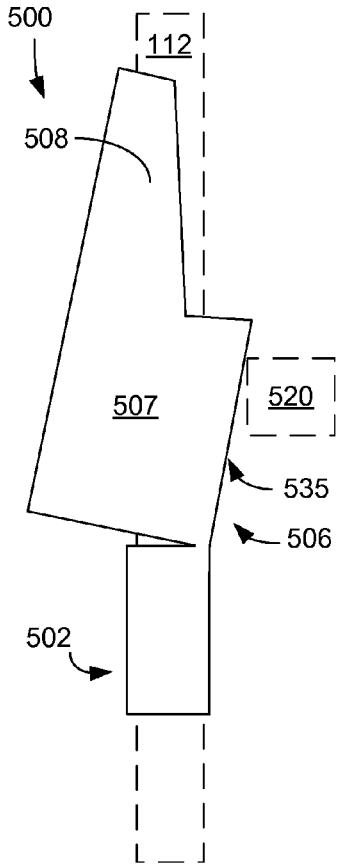
FIG. 5E is a top plan view illustrating an exemplary drawer safety latch being forced against bias by an environmental obstacle, according to a preferred embodiment of the present invention.
Figure 5B:
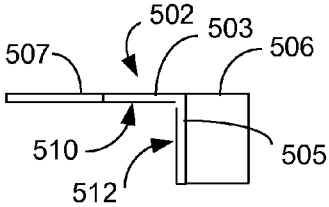
FIG. 5B is a rear elevation view illustrating an exemplary drawer safety latch engaging an environmental obstacle, according to a preferred embodiment of the present invention.

FIG. 5B is a rear elevation view illustrating an exemplary drawer safety latch 500 engaging an environmental obstacle 520, according to a preferred embodiment of the present invention. First mounting portion 503 has a first surface 510 for engaging and securing to top surface 112 of drawer side structure 116. Preferably, first surface 510 has a width sized to span the top surface 112. Second surface 512, a surface of bracing extension 505, abuts exterior surface 515 of drawer side structure 116. Preferably, the width of second surface 512 equals the width of first surface 510. While the edges of the aforementioned structures have been illustrated as sharp, right-angled edges, the invention is not so limited. For example, and without limitation, rounded or beveled edges may be produced.

FIG. 5C is a top plan view illustrating an exemplary drawer safety latch 500 released from engaging an environmental obstacle 520, according to a preferred embodiment of the present invention. Manual force applied to release portion 508 along edge 525 may be used to flex the flexible coupling 504 and move the release portion 508 and obstructing portion 506 to release engagement of the environmental obstacle 520. While a one-piece construction is strongly preferred, flexible coupling 504 may, in an alternate embodiment, be a discrete element, such as a hinge.

Figure 5D:
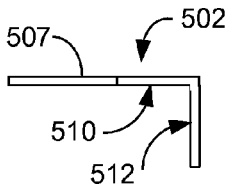
FIG. 5D is a rear elevation view illustrating an exemplary drawer safety latch released from engaging an environmental obstacle, according to a preferred embodiment of the present invention.

FIG. 5D is a rear elevation view illustrating an exemplary drawer safety latch 500 released from engaging an environmental obstacle 520, according to a preferred embodiment of the present invention. Obstructing portion 506 has rotated out of this view, as compared to FIG. 5B. While the exemplary drawer safety latch 500 is illustrated as having a uniform thickness, the invention is not so limited.

FIG. 5E is a top plan view illustrating an exemplary drawer safety latch 500 being forced against bias by an environmental obstacle 520, according to a preferred embodiment of the present invention. After the drawer safety latch 500 has been released and the drawer opened, the obstructing portion 506 and the release portion 508 return to their quiescent biased state. As the drawer is closed, the edge 535 of obstructing portion 506 slidingly engages the environmental obstacle 520, forcing the drawer safety latch 500 toward the released position as the drawer moves rearward. Thus, no operation of the release portion 508 is required for closing the drawer.

Figure 5F:
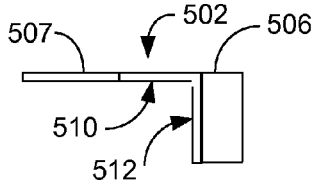
FIG. 5F is a rear elevation view illustrating an exemplary drawer safety latch being forced against bias by an environmental obstacle, according to a preferred embodiment of the present invention.

FIG. 5F is a rear elevation view illustrating an exemplary drawer safety latch 500 being forced against bias by an environmental obstacle 520, according to a preferred embodiment of the present invention. Obstructing portion 506 does not move completely to the released position, but only as far as the environmental obstacle 520 requires.

Figure 6A:
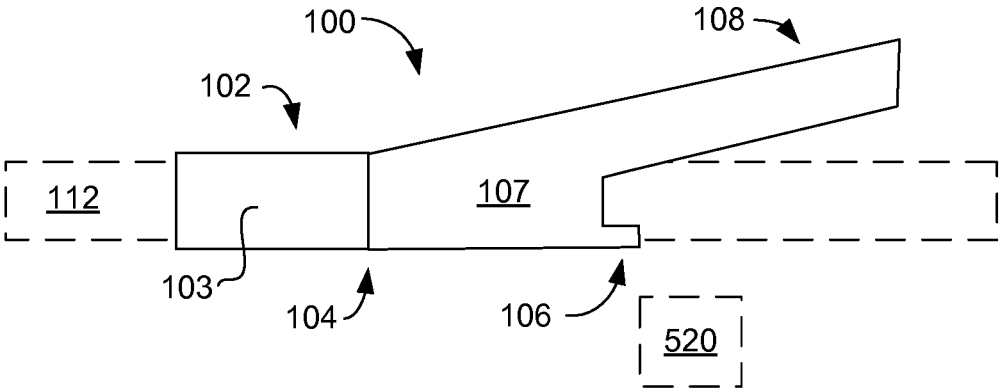
FIG. 6A is a top plan view illustrating an exemplary drawer safety latch fully released from engaging an environmental obstacle, according to a preferred embodiment of the present invention.

FIG. 6A is a top plan view illustrating an exemplary drawer safety latch 100 fully released from engaging an environmental obstacle 520, according to a preferred embodiment of the present invention. FIG. 6A provides reference for FIG. 6B.

Figure 6B:
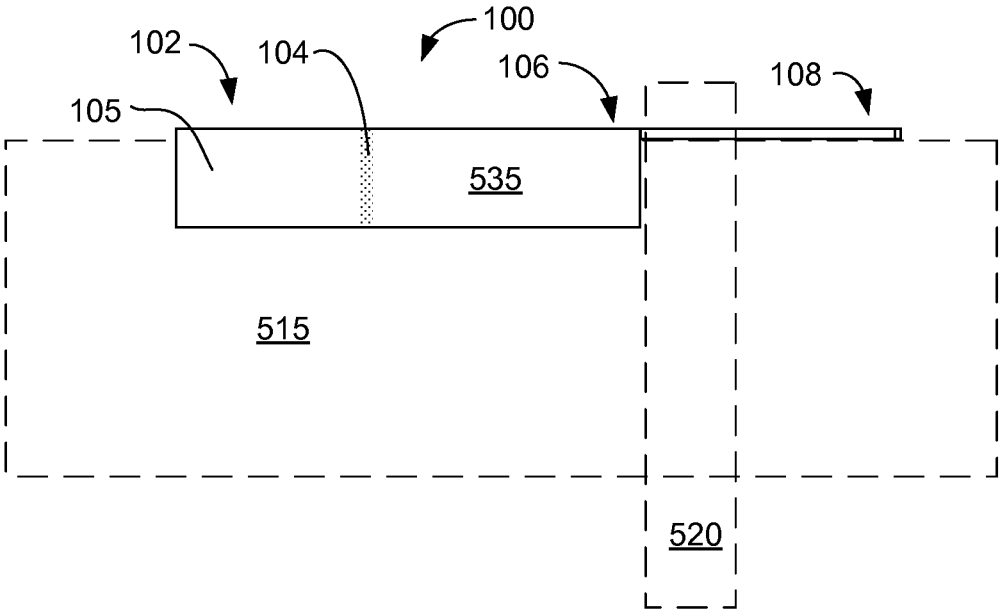
FIG. 6B is a side elevation view illustrating an exemplary drawer safety latch fully released from engaging an environmental obstacle, according to a preferred embodiment of the present invention.

FIG. 6B is a side elevation view illustrating an exemplary drawer safety latch 100 fully released from engaging an environmental obstacle 520, according to a preferred embodiment of the present invention. Bracing extension 105 preferably abuts exterior surface 515. Flexible coupling 104 preferably has extends across one end of bracing extension 105, as shown. Surface 535 of obstructing portion 106 extends forward beyond flexible coupling 104. The top edge of surface 535 joins panel 107 (see FIG. 6A), which extends to form release portion 108.

Figure 7A:
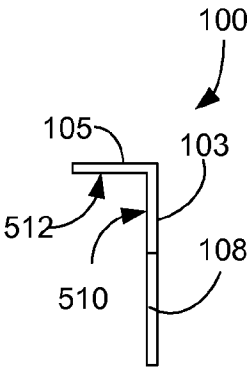
FIG. 7A is a rear elevation view illustrating an exemplary drawer safety latch in a second orientation fully released from engaging an environmental obstacle, according to a preferred embodiment of the present invention.

FIG. 7A is a rear elevation view illustrating an exemplary drawer safety latch 100 in the second orientation fully released from engaging an environmental obstacle (not shown), according to a preferred embodiment of the present invention. Because the drawer safety latch 100 is in the second orientation, the roles of mounting portion 103 and bracing extension 105 are reversed. First surface 510 of first mounting portion 103 abuts interior surface 110 of drawer side structure 116. Second surface 512 of bracing extension 105 engages and is secured to top surface 112 of drawer side structure 116. Release portion 108 extends downward in the second orientation.

Figure 7B:
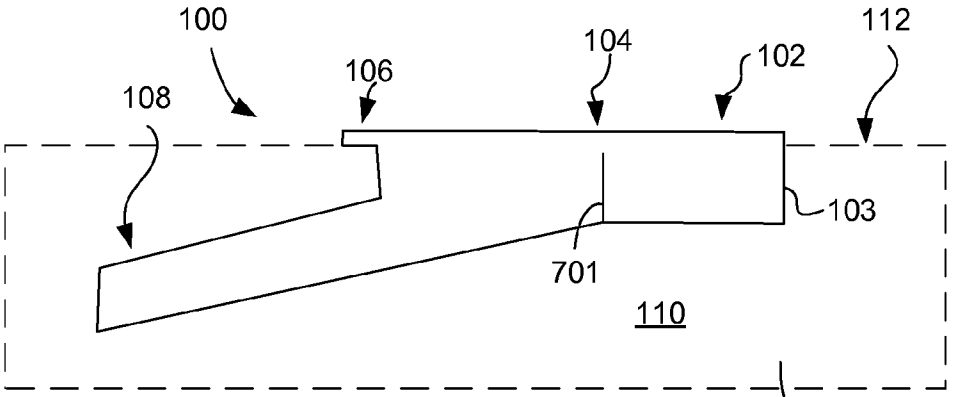
FIG. 7B is a side elevation view illustrating an exemplary drawer safety latch in a second orientation fully released from engaging an environmental obstacle, according to a preferred embodiment of the present invention.

FIG. 7B is a side elevation view illustrating an exemplary drawer safety latch 100 in a second orientation fully released from engaging an environmental obstacle (not shown), according to a preferred embodiment of the present invention. The obstructing portion 106 is close to top surface 112, allowing for a fairly small clearance between the top surface 112 and the nearest environmental obstacle. Preferably, the thickness of the material used is about one-sixteenth to three thirty-seconds of an inch.

When cutting a right-angled section of plastic to form drawer safety latch 100, it is suggested that the outline of the mounting portion 102, obstructing portion 106, and release portion 108 be cut first, to form the outline as shown in FIG. 7B. Next, a straight cut 701 may be made, as shown. Last, the flexible coupling 104 may be biased to the desired angle.

Figure 7C:
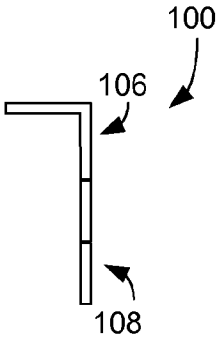
FIG. 7C is a front elevation view illustrating an exemplary drawer safety latch in a second orientation fully released from engaging an environmental obstacle, according to a preferred embodiment of the present invention.

FIG. 7C is a front elevation view illustrating an exemplary drawer safety latch 100 in a second orientation fully released from engaging an environmental obstacle (not shown), according to a preferred embodiment of the present invention. Obstructing portion 106 has an L-shape when viewed from the front. Preferably, the horizontal portion of the L-shape engages the environmental obstacle in the second orientation.

Figure 7D:
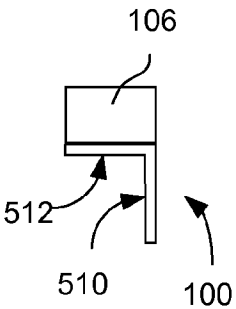
FIG. 7D is a rear elevation view illustrating an exemplary drawer safety latch in a second orientation positioned to engage an environmental obstacle, according to a preferred embodiment of the present invention.

FIG. 7D is a rear elevation view illustrating an exemplary drawer safety latch 100 in a second orientation positioned to engage an environmental obstacle (not shown), according to a preferred embodiment of the present invention. Obstructing portion 106 is shown raised to its quiescent, outwardly biased position.

Figure 7E:
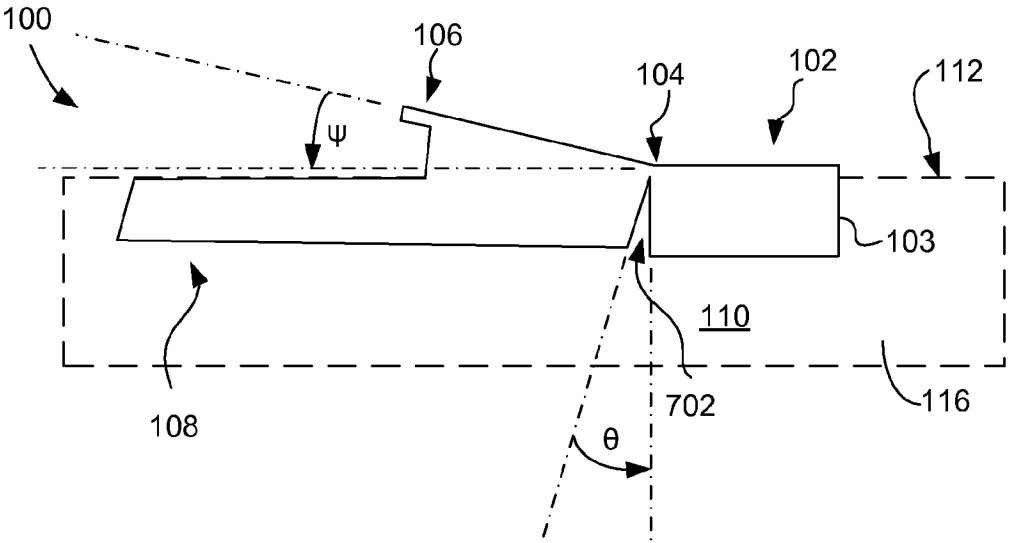
FIG. 7E is a side elevation view illustrating an exemplary drawer safety latch in a second orientation positioned to engage an environmental obstacle, according to a preferred embodiment of the present invention.

FIG. 7E is a side elevation view illustrating an exemplary drawer safety latch 100 in a second orientation positioned to engage an environmental obstacle (not shown), according to a preferred embodiment of the present invention. An angled gap 702 is provided between the mounting portion 102 and the obstructing portion 106. The angled gap 102 is aligned to the flexible coupling 104. The angle θ of the angled gap 702 should be at least as big as the angle ψ that represents the outward bias angle of the obstructing portion 106. As long as θ≧ψ, the obstructing portion 106 can be rotated adjacent to the drawer side structure 116 to provide for close clearances between the drawer side structure 116 and environmental obstacles. In an embodiment formed from cutting angled plastic, angled gap 702 may result from cut 701 being biased open by biasing flexible coupling 104. Release portion 108 is preferably sized and shaped to remain lower than the top surface 112 of drawer side structure 116 when the drawer safety latch 100 is in the outwardly biased position in the second orientation.

Figure 7F:
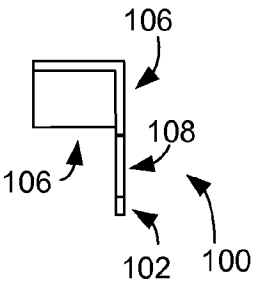
FIG. 7F is a front elevation view illustrating an exemplary drawer safety latch in a second orientation positioned to engage an environmental obstacle, according to a preferred embodiment of the present invention.

FIG. 7F is a front elevation view illustrating an exemplary drawer safety latch 100 in a second orientation positioned to engage an environmental obstacle (not shown), according to a preferred embodiment of the present invention. The front view of the outwardly biased obstructing portion 106 is illustrated.

Figure 8A:
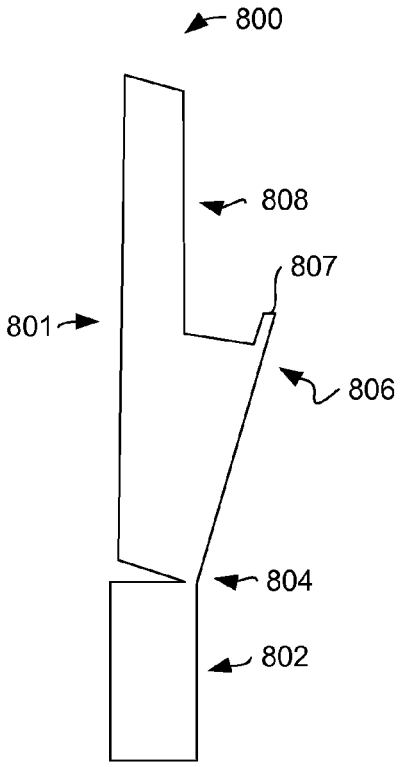
FIG. 8A is a top plan view illustrating another exemplary drawer safety latch, according to a preferred embodiment of the present invention.

FIG. 8A is a top plan view illustrating another exemplary drawer safety latch 800, according to a preferred embodiment of the present invention. Drawer safety latch 800 includes body 801 and mounting bracket 802 coupled by flexible coupling 804. Body 801 includes obstructing portion 806 and release portion 808. Obstructing portion 806 includes extension 807, which is operable to actually make contact with an environmental obstacle. The FIGS. 8B through 8F that follow are intended to illustrate, without limitation, the variety of shapes that may be produced in forming drawer safety latches.

Figure 8B:
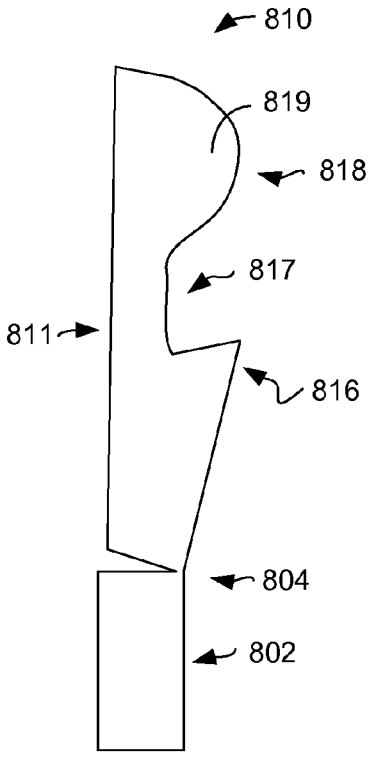
FIG. 8B is a top plan view illustrating another exemplary drawer safety latch, according to a preferred embodiment of the present invention.

FIG. 8B is a top plan view illustrating another exemplary drawer safety latch 810, according to a preferred embodiment of the present invention. Drawer safety latch 810 includes body 811 and mounting bracket 812 coupled by flexible coupling 814. Body 811 includes obstructing portion 816 and release portion 818. Protrusion 819 of release portion 818 may extend outward from the edge of the drawer to enable easy release of the drawer safety latch 810. Preferably, drawer safety latches 810 are installed in left-handed and right-handed pairs, making the release of the drawer safety latches 810 an easy two-handed operation for an adult, but a difficult task for a small child. Notch 817 is operable to receive a portion of an environmental obstacle. The curvature of protrusion 819 must allow the environmental obstacle to deflect the release as the drawer is closed. Variation in the dimensions and shape of protrusion 819 may be made within the scope of the present invention.

Figure 8C:
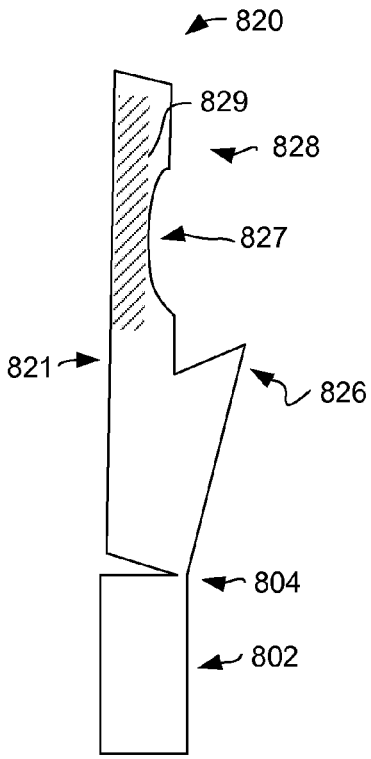
FIG. 8C is a top plan view illustrating another exemplary drawer safety latch, according to a preferred embodiment of the present invention.

FIG. 8C is a top plan view illustrating another exemplary drawer safety latch 820, according to a preferred embodiment of the present invention. Drawer safety latch 820 includes body 821 and mounting bracket 822 coupled by flexible coupling 824. Body 821 includes obstructing portion 826 and release portion 828. Scalloped portion 827, a traction enhancement, in release portion 828 is preferably sized, shaped and arranged to receive a human finger that activates the release. Roughened surface 829, another traction enhancement, improves traction with the user's finger when operating the release. Roughening may be by various means, including, without limitation, molding, embossing, engraving, and dimpling.

Figure 8D:
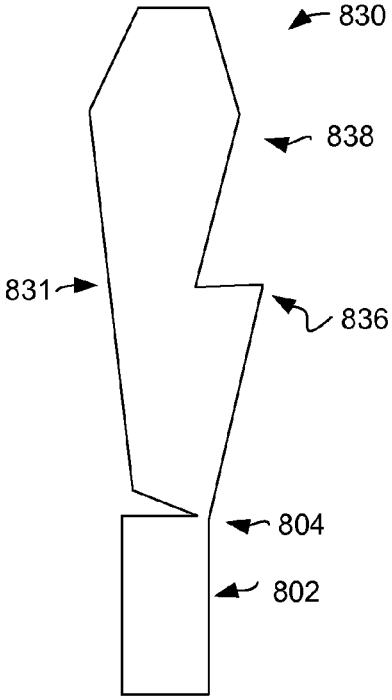
FIG. 8D is a top plan view illustrating another exemplary drawer safety latch, according to a preferred embodiment of the present invention.

FIG. 8D is a top plan view illustrating another exemplary drawer safety latch 830, according to a preferred embodiment of the present invention. Drawer safety latch 830 includes body 831 and mounting bracket 832 coupled by flexible coupling 834. Body 831 includes obstructing portion 836 and release portion 838. Body 831 features an angled perimeter that may be easily achieved by cutting or trimming. The surface of any drawer safety latch, such as drawer safety latch 830, may have aesthetic enhancements, such as a design or pattern for informational or decorative purposes. Likewise, the material forming the drawer safety latch 830 may be of any color, translucent, or transparent. While resilient plastic is strongly preferred for economy of production, a drawer safety latch, such as drawer safety latch 830, may be made of any suitable material, including, without limitation, metal, wood, ceramic, composite, or bone.

Figure 8E:
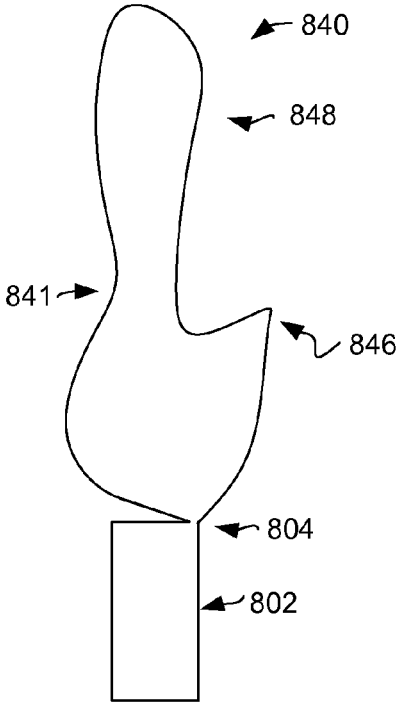
FIG. 8E is a top plan view illustrating another exemplary drawer safety latch, according to a preferred embodiment of the present invention.

FIG. 8E is a top plan view illustrating another exemplary drawer safety latch 840, according to a preferred embodiment of the present invention. Drawer safety latch 840 includes body 841 and mounting bracket 842 coupled by flexible coupling 844. Body 841 includes obstructing portion 846 and release portion 848. The body 841 of drawer safety latch 840 has a completely curved perimeter. This may be accomplished to avoid pointed portions of the edge of body 841, or for aesthetic reasons. Drawer safety latch 840 may, in alternate embodiments, have aesthetic enhancements, such as sculpting or decoration.

Figure 8F:
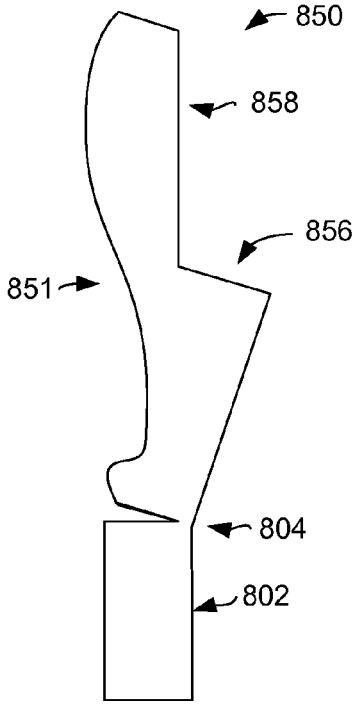
FIG. 8F is a top plan view illustrating another exemplary drawer safety latch, according to a preferred embodiment of the present invention.

FIG. 8F is a top plan view illustrating another exemplary drawer safety latch 850, according to a preferred embodiment of the present invention. Drawer safety latch 850 includes body 851 and mounting bracket 852 coupled by flexible coupling 854. Body 851 includes obstructing portion 856 and release portion 858. Drawer safety latch 850 illustrates having only one portion of the edge of body 851 curved. Any shape desired for body 851, within the constraint of the required functionality, is anticipated by the present invention.

Figure 9:
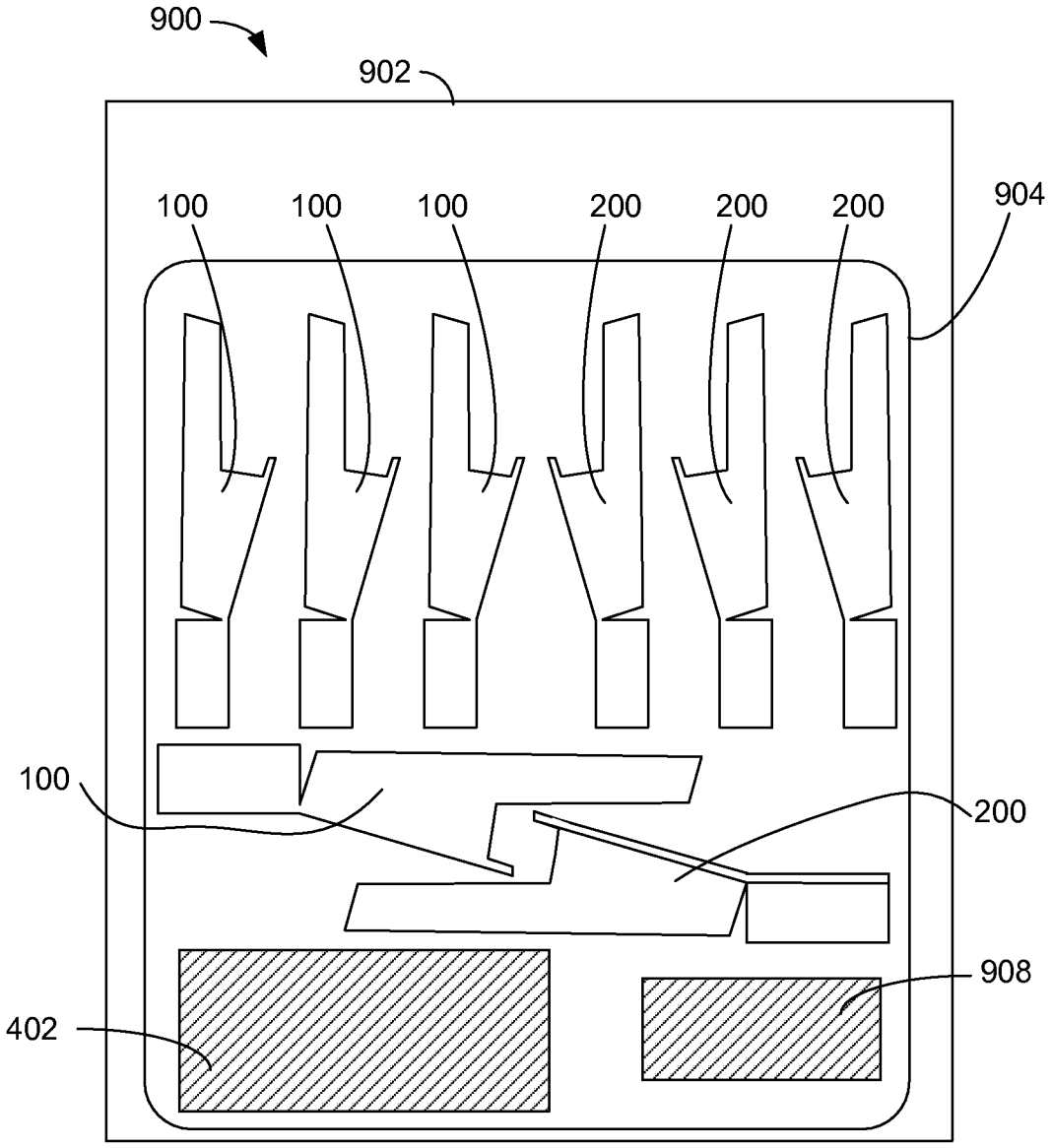
FIG. 9 is a front elevation view illustrating an exemplary package for drawer safety latches and adhesive fabrics, according to a preferred embodiment of the present invention.

FIG. 9 is a front elevation view illustrating an exemplary package 900 for drawer safety latches 100 and 200 and adhesive fabrics 402 and 908, according to a preferred embodiment of the present invention. A backing card 902 supports a clear plastic container 904 that contains drawer safety latches 100 and 200 of various sizes. Packages containing various numbers and sizes of drawer safety latches, such as drawer safety latches 100 and 200, are within the scope of the present invention. The adhesive fabrics 402 and 908 are preferably supplied in strips sized for each size of drawer safety latch 100 and 200, as shown. Preferably, each package 900 contains more adhesive fabric 402 and 908 strips than drawer safety latches 100 and 200, to support portability. As an adhesive fabric 402 or 908 strip becomes ineffective with multiple reuse, it can be replaced from the store of extra adhesive fabric 402 or 908 strips in the package. The adhesive fabric 402 and 908 strips preferably have an easily removable cover, such as a film, to prevent the adhesive from being prematurely engaged.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A drawer safety latch for a drawer having at least one drawer side structure, said drawer safety latch comprising:

a first mounting portion having comprising a first surface installable, in a first orientation, to engage and to be secured to at least a portion of at least one top surface of one drawer side structure;

a bracing extension comprising a one second surface extending at an angle from said at least one first surface of said mounting portion, operable, in said first orientation, to abut at least one exterior surface of the drawer side structure;

a flexible portion extending forwardly from said bracing extension;

an obstructing portion extending forwardly from said flexible portion, biased outwardly from the drawer, operable to engage at least one environmental obstacle, and comprising at least one panel oriented in a plane at said angle to said bracing extension; and a releasing portion extending forwardly from said at least one panel and operable to release said obstructing portion;

wherein said drawer latch is operable to be installed in one of said first orientation and a second orientation, wherein, in said second orientation, said second surface is installable to engage and to be secured to the at least one top surface of the drawer side structure and said first surface is operable to abut the at least one interior surface of the drawer side structure.

2. The drawer safety latch of claim 1, wherein said first surface is installable, in said first orientation, to be releasably secured to the at least one top surface of the drawer side structure.

3. The drawer safety latch of claim 1, wherein said second surface is installable, in said second orientation, to be releasably secured to the at least one top surface of the drawer side structure.

4. The drawer safety latch of claim 1, wherein said mounting portion is secured to the at least one top surface by means of overlaying an adhesive fabric on said mounting portion, said adhesive fabric extending to adhesively engage at least a portion of the at least one interior surface of the drawer side structure and at least a portion of the at least one exterior surface of the drawer side structure.

5. The drawer safety latch of claim 1, wherein said drawer safety latch is sized, shaped, and arranged to be installed on the drawer side structure on one of a left-hand drawer side structure and a right-hand drawer side structure.

6. The drawer safety latch of claim 1, contained in a package, said package further containing at least one adhesive.

7. The drawer safety latch of claim 6, wherein said at least one adhesive comprises adhesive fabric.

8. The drawer safety latch of claim 1, wherein said first surface has a width sized to span the at least one top surface of the drawer side structure and said second surface has an equal width to said first surface.

9. The drawer safety latch of claim 1, wherein said releasing portion is sized, shaped, and arranged to not extend exterior to the drawer.

10. The drawer safety latch of claim 1, further comprising a one-piece construction.

11. The drawer safety latch of claim 1, further comprising injection-molded plastic.

12. The drawer safety latch of claim 1, further comprising at least one aesthetic enhancement.

13. The drawer safety latch of claim 1, further comprising at least one traction enhancement.

14. A drawer safety latch for a drawer, comprising:

a mounting bracket sized, shaped, and arranged to be securable to a top surface of a side structure of the drawer in one of a first orientation and a second orientation;

an outwardly-biased obstructing member flexibly coupled to said mounting bracket and operable to engage an environmental obstacle to obstruct the opening of the drawer; and a releasing member coupled to said obstructing member and operable to move said obstructing member to release said obstructing member from engagement with the environmental obstacle, wherein said mounting bracket comprises first and second surfaces and said first orientation comprises said first surface engaging the top surface of the side structure and said second surface abutting an exterior surface of the side structure and said second orientation comprises said second surface engaging the top surface of the side structure and said first surface abutting an interior surface of the side structure.

15. The drawer safety latch of claim 14, wherein said mounting bracket is releasably securable to the top surface of the drawer side structure.

16. The drawer safety latch of claim 14, further sized, shaped, and arranged to be installed on the drawer side structure on one of a left-hand drawer side structure and a right-hand drawer side structure.

17. The drawer safety latch of claim 14, wherein said mounting bracket is secured to the top surface by means of overlaying an adhesive fabric on said mounting bracket, said adhesive fabric extending to adhesively engage at least a portion of the interior surface of the drawer side structure and at least a portion of the exterior surface of the drawer side structure.

18. The drawer safety latch of claim 14, wherein said releasing member is sized shaped and arranged to not extend exterior to the drawer.

19. The drawer safety latch of claim 14, contained in a package, said package further containing at least one adhesive.

20. The drawer safety latch of claim 15, wherein said at least one adhesive comprises an adhesive fabric.

21. A drawer safety latch for a drawer, comprising an L-shaped mounting bracket sized, shaped, and arranged to be securable to a top surface of a drawer side structure in one of a first position and a second position;

an outwardly biased body having an obstructing portion operable to engage an environmental obstacle and a release portion operable to disengage said obstructing portion from the environmental obstacle, said body flexibly coupled to said L-shaped mounting;

wherein said mounting bracket comprises first and second surfaces interior to said L-shaped mounting, and said first position comprises said first surface engaging the top surface of the drawer side structure and said second surface engaging an exterior surface of the drawer side structure, and said second position comprises said second surface engaging the top surface of the drawer side structure and said first surface engaging an interior surface of the drawer side structure.

22. The drawer safety latch of claim 21, comprising a single piece of injection-molded plastic.

23. The drawer safety latch of claim 21, comprising a single piece cut from a right-angle length of plastic.

24. The drawer safety latch of claim 21, wherein said L-shaped mounting bracket is releasably securable to the top surface of the drawer side structure.

25. The drawer safety latch of claim 21, wherein said body comprises an aesthetic enhancement.

26. The drawer safety latch of claim 21, wherein said release portion comprises a traction enhancement.

* * * * *